US011104015B2

(12) United States Patent
Wada

(10) Patent No.: US 11,104,015 B2
(45) Date of Patent: Aug. 31, 2021

(54) SHEARS

(71) Applicant: Chikamasa Co. Ltd., Osaka-fu (JP)

(72) Inventor: Yoshikazu Wada, Sakai (JP)

(73) Assignee: Chikamasa Co. Ltd., Sakai (JP)

( * ) Notice: Subject to any disclaimer, the term of this patent is extended or adjusted under 35 U.S.C. 154(b) by 0 days.

(21) Appl. No.: 16/550,158

(22) Filed: Aug. 23, 2019

(65) Prior Publication Data

US 2020/0061853 A1 Feb. 27, 2020

(30) Foreign Application Priority Data

Aug. 23, 2018 (JP) ..... JP2018-156000

(51) Int. Cl.
*B26B 13/28* (2006.01)

(52) U.S. Cl.
CPC ..... *B26B 13/28* (2013.01)

(58) Field of Classification Search
CPC ..... B26B 13/28
See application file for complete search history.

(56) References Cited

U.S. PATENT DOCUMENTS 1,324,598 A * 12/1919 Koehler ..... B26B 13/28 30/267
1,741,803 A * 12/1929 Zeidler ..... B26B 13/28 30/266
1,987,935 A * 1/1935 Herrick ..... B26B 13/28 30/268
RE20,525 E * 10/1937 Brangs ..... B26B 13/28 76/106.5
2,284,859 A * 6/1942 Blair ..... B26B 13/28 30/248
2,650,845 A * 9/1953 Dalley ..... B26B 13/28 403/162
3,434,763 A * 3/1969 Gerner ..... F16C 11/04 384/218
6,131,291 A * 10/2000 Mock ..... B26B 13/28 30/266
2005/0044724 A1* 3/2005 Lin ..... B26B 13/28 30/266
2005/0092503 A1* 5/2005 Chen ..... B25F 5/006 173/104

(Continued)

FOREIGN PATENT DOCUMENTS

JP 2017-000696 1/2017

*Primary Examiner* — Ghassem Alie
*Assistant Examiner* — Fernando A Ayala
(74) *Attorney, Agent, or Firm* — James Judge

(57) ABSTRACT

Shears configured with blade pieces having pin holes, at least one of which is polygonal, along basal ends of the blade pieces, and a pin-hole swivel pin, and provided with grooves on either of opposing inner-side faces of the blade pieces. When the shears are in a predetermined open/close state, the grooves lead from the pin holes to the blade pieces' exterior. The pin is constituted by a columnar pin shank ending in cap portions. Rotatable, the pin shank interiorly contacts the polygonal pin hole's sides. The cap portion along the at least one blade piece having the polygonal pin hole has an opening interconnecting a gap between the pin hole and the pin shank with the cap portion's outer side. The grooves, the pin-hole/pin-shank gap, and the opening secure washing-fluid or air channels for cleaning out the pin holes, and realize a light, jiggle-free operational feel.

17 Claims, 8 Drawing Sheets

(56) References Cited

U.S. PATENT DOCUMENTS

| | | | | |
|---|---|---|---|---|
| 2005/0188543 | A1* | 9/2005 | Yeh | B26B 13/28<br>30/254 |
| 2006/0067787 | A1* | 3/2006 | Nelson | A01G 3/0475<br>403/408.1 |
| 2007/0068006 | A1* | 3/2007 | Schlichting | B26B 13/00<br>30/254 |

* cited by examiner

SHEARS

BACKGROUND

Technical Field

The present invention relates to shears; more particularly, it relates to shears whose section with the pin that the two cutting portions swivel on is cleanable.

Description of Related Art

A problem with conventional shears has been that (a) when they are used in orchards or in similar farm work, sap gum can build up in the section with the shears' pin, such that excessive force is required for the open/close action. In other cases, (b) when used in everyday households in cooking meats or fish, (c) when used for haircutting at a barber's or hairdresser's, or (d) when used in factories or the like, foreign matter, highly viscous grease, sticky substances, etc. build up in the section with the shears' pin, such that neglecting the situation risks that excessive force will be required for the open/close action.

Japanese Utility Model App. Pub. No. H02-122666, for example, proposes shears whose pin section is made removable, facilitating cleaning.

Nevertheless, in order that the shears sharply cut what is nipped between the two cutting portions, the pin holds the two cutting portions with a delicate power balance so that they open and close while rubbing against each other with a slight force. Consequently, the configuration for removing the pin section is less than ideal because it leads to inconsistencies in how the shears handle during use.

SUMMARY

An object of the present invention, brought about to resolve the problems with the above-described conventional example, is to make available shears provided with a configuration, taking into consideration how the shears handle during use, whereby foreign matter, highly viscous grease, sticky substances, etc. built up in the section with the pin can be cleaned out even without removing the pin section.

In order to accomplish the just-stated objective, the present invention, in shears (1) configured with two blade pieces (5 and 9), having respective cutting portions (3 and 7) and pin holes (4 and 8) along the basal ends of the cutting portions, swiveling on a pin (20) passing through the pin holes, is characterized in: at least one of the blade pieces being provided with, on an inner-side face thereof opposing an inner-side face of the other of the blade pieces, grooves (10) leading, when the cutting portions are in a closed state and/or have been put into a predetermined open state, from the pin hole in the least one blade piece exteriorly where the at least one blade piece has the pin hole; that of the two blade pieces, in at least one of the blade pieces the pin hole is polygonally bored; that the pin comprises a pin shank (21*b*) and cap portions (21*c* and 23) provided on either end of the pin shank, wherein the pin shank has a columnar form with a diameter whereby in a rotatable state the shank interiorly contacts the sides of the polygonally bored pin hole(s); and that the pin cap portion along the at least one blade piece having the polygonally bored pin hole has an opening (22*a*) interconnecting a gap, made between the polygonally bored pin hole(s) and the pin shank, with the outer side of the cap portion.

It is preferable that of the two blade pieces, in one of the blade pieces the pin hole is polygonally bored, and in the other of the blade pieces the pin hole is circularly bored; wherein the pin shank is configured as the columnar pin shank of a rivet; the cap portion along the blade piece having the polygonally bored pin hole is configured by the rivet head of the rivet, and by a C-shaped washer a section of whose arc is cut out, forming the opening; and the other cap portion, along the blade piece having the circularly bored pin hole, is configured as a cap portion formed by the rivet's pin shank being crimped so that the two blade pieces are held pivotably in the pin hole.

It is preferable to furnish either one of or both (a) a groove provided leading from a pin hole to the edge of a blade piece where it has the pin hole, and (b) a furrow provided passing, in a situation where the open/close state is set so as to make an area where a part or the entirety of the blade piece's cutting portion does not overlap, from the pin hole to the area where it does not overlap.

It is preferable that the polygonally bored pin hole is squarely bored.

It is preferable that the above-described grooves extend radially from the pin hole.

The pin shank (21*b*) may be configured as the columnar shank of a rivet (21), with one of the cap portions (23) being configured by the rivet head of the rivet, and by a C-shaped washer (22) a section of whose arc is cut out, forming the opening; and the other cap portion (21*c*) being configured as a cap portion formed by the rivet's pin shank being crimped so that the two blade pieces are held pivotably in the pin hole.

The present invention utilizes channels formed by the grooves, by the space formed between the polygonal pin hole and the columnar pin shank, and by the opening to make it possible to flush out, with washing fluid or air, resinous gum, foreign matter, highly viscous grease, sticky substances, etc. built up in the pin holes, and enable cleaning to be easily, reliably carried out without removing the pin section—that is, without being accompanied by needless change in the feel during handling and operation. At the same time, adopting a configuration in which the columnar pin shank is interiorly contacted rotatably against the sides of the polygonal pin hole, compared with configurations in which the pin hole is columnar, does away with areas where the pin hole and pin shank come into surface contact, to realize a light operational feel, and further, with no knocking of the pin shank unilaterally against the pin hole, to realize a jiggle-free operational feel.

DETAILED DESCRIPTION

Shears involving the present invention are configured with two blade pieces, respectively having cutting portions and pin holes along the basal end of the cutting portions, swiveling on a pin passing through the pin holes. Grooves leading from the pin holes to the exterior of the blade pieces where they have the pin holes are provided on one of or both the two blade pieces. The shears are characterized in that the pin hole(s) in one of or both the two blade pieces is formed polygonally, for example, squarely, and further in that the shank of the pin inserted into the pin holes is circular in cross-section, and a pin cap portion along the at least one blade piece having the polygonally bored pin hole has an opening interconnecting a gap, made between the pin hole and the pin shank, with the outer side of the cap portion.

Utilizing channels formed by the grooves, by the space formed between the polygonal pin hole and the columnar pin shank, and by the opening to make it possible to flush out, with washing fluid or air, resinous gum, foreign matter, highly viscous grease, sticky substances, etc. built up in the pin holes, carrying out easy, reliable cleaning without removing the pin section—that is, without an accompanying needless change in the feel during handling and operation—is made possible. At the same time, adopting a configuration in which the columnar pin shank is interiorly contacted rotatably against the sides of the polygonal pin hole, compared with configurations in which the pin hole is columnar, can do away with areas where the pin hole and pin shank come broadly into surface contact, to realize a light operational feel, and further, with no knocking of the pin shank unilaterally against the pin hole, to realize a jiggle-free operational feel. It should be understood that while necessity to remove the pin in cleaning out the pin hole of shears of the present invention is eliminated, decreasing circumstances where the feel during handling and operation becomes altered, it does not mean that employing a removable pin for the sake of, for example, maintenance on or replacement of the cutting portions of the blade pieces is prohibited.

Figure 1A:
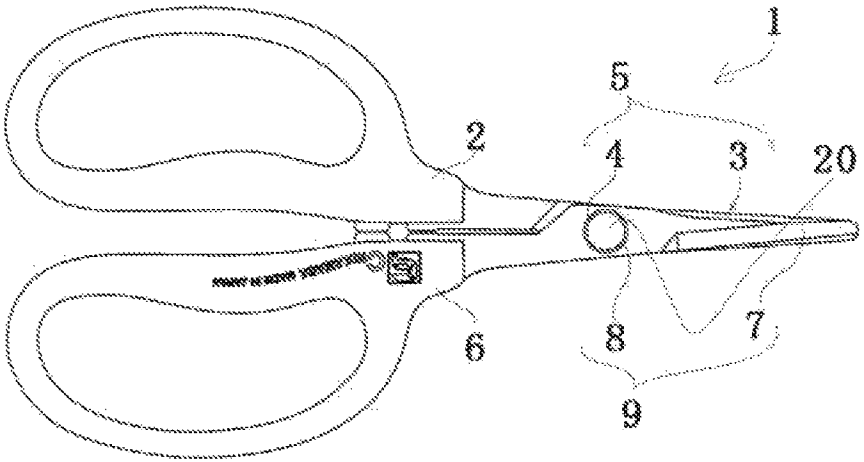
FIG. 1A is an obverse-side view of shears involving one mode of embodying the present invention.

Referring to the accompanying drawings, a description of shears 1 involving one mode of embodying the present invention will be made. FIG. 1A presents an obverse-side view, and FIG. 1B an underside view, of the shears 1. The shears 1 have a configuration in which a blade piece 5 to which a handle 2 for gripping with the hand is attached and having, located along the lower side of FIG. 1B, a cutting portion 3 constituting the lower shear and a pin hole 4 in the basal end of the cutting portion 3, and a blade piece 9 to which a handle 6 is attached and having, located along the upper side of FIG. 1B, a cutting portion 7 constituting the upper shear and a pin hole 8 in the basal end of the cutting portion 7, are fastened pivotably by a columnar pin 20 that passes through the pin holes 4 and 8.

The blade piece 9 has a square pin hole 8 having sides of approximately the same length as the shank of the pin 20, and grooves 10 that, when the cutting portion 7 has been put in predetermined open/closed state, pass from the pin hole 8 to the exterior of blade piece 9 where it has the pin hole 8. Specifically, grooves encompassing the square pin hole 8, and grooves extending radially are provided as the grooves 10. The blade piece 5 has a round pin hole 4 of approximately the same diameter as the shank of the pin 20. Preferably the blade piece 5 has grooves of the same structure as the grooves 10.

The pin 20 is constituted by a shank, and cap portions provided on either end of the shank. In the shears 1, the pin 20 is constituted by a rivet 21 having a columnar shaft, and a C-shaped washer 22 a section of whose arc is cut out, forming an opening. The rivet 21 is constituted by a rivet head 21*a*, a columnar shank 21*b*, and a cap portion 21*c* formed by the tip end of the shank 21*b* being crimped. The shank 21*b* of the rivet 21 corresponds to the shank of the pin 20. The rivet head 21*a* and the C-shaped washer 22 correspond to one of the cap portions of the pin 20; in the following they will be expressed together as "cap portion 23." It should be understood that the cap portion 23 may be an integral formation of the rivet head 21*a* and the washer 22. A cap portion 21*c* formed by the shank of the rivet 21 being crimped so as to fasten the two blade pieces 5 and 9 pivotably in the pin holes 4 and 8 corresponds to the other cap portion of the pin 20. Crimping the rivet 21 enlarges the diameter of the shank 21*b* nearby the pin hole 4, fitting it tightly into the round pin hole 4, and anchoring the shank 21*b* of the pin 20 into the blade piece 5.

FIG. 2 presents six drawings of the blade piece 9 constituting the upper shear. FIG. 2A presents an obverse-side view, FIG. 2B a plan view, FIG. 2C an underside view, FIG. 2D a reverse-side view, FIG. 2E a left-side view, and FIG. 2F a sectional view along, seen in the direction of the arrows of, A-A' in FIG. 2D. The pin hole 8 in the blade piece 9 is in triangular, quadrilateral, pentagonal, hexagonal, or other polygonal form, of dimension whereby the shank 21*b* (not shown in FIG. 2) of the pin 20 virtually contacts each side in a rotatable state. Adopting such configuration not only forms cleaning channels between the pin hole and the shank, but, compared with configurations in which the pin hole is columnar, does away with areas where the pin hole and shank come into surface contact, as a result enabling comparatively long-term, light open/close operation without removal of the shank 21*b* (not shown in FIG. 2) along the inner side of the pin hole 8, even when resinous gum, foreign matter, highly viscous grease, sticky substances, etc. have built up.

Figure 2A:
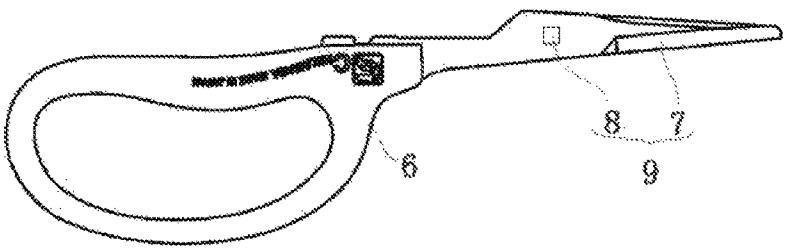
FIG. 2A is an obverse-side view of a blade piece constituting the upper shear of the same shears.
Figure 2B:
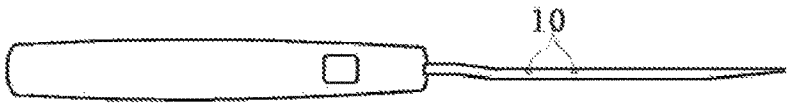
FIG. 2B is a plan view thereof.
Figure 2C:
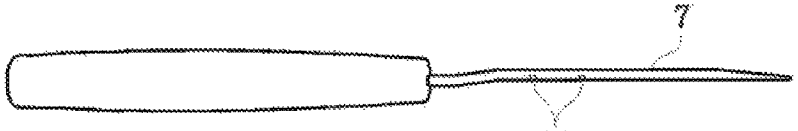
FIG. 2C is an underside view thereof.
Figure 2D:
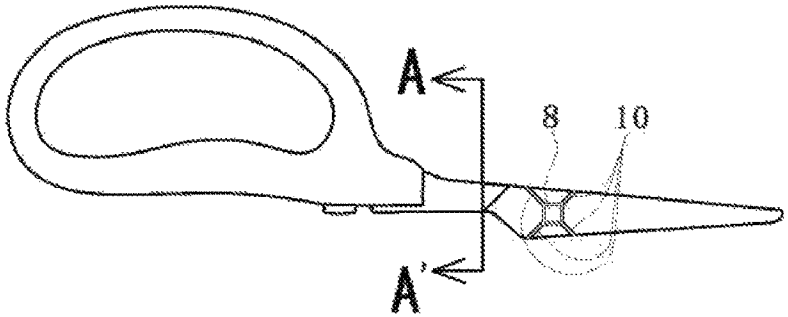
FIG. 2D is a reverse-side view thereof.
Figure 2E:
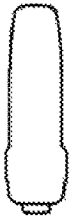
FIG. 2E is a left-side view thereof.
Figure 2F:
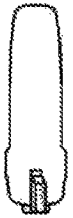
FIG. 2F is a sectional view along, seen in the direction of the arrows of, A-A' in FIG. 2D.
Figure 3A:
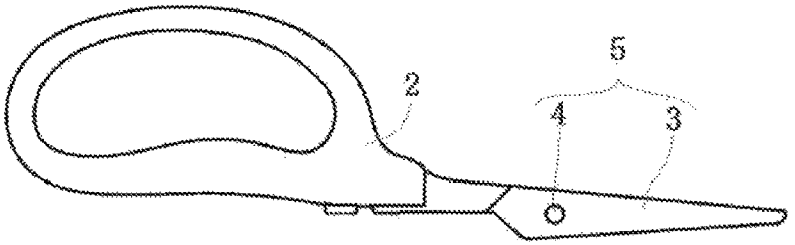
FIG. 3A is an obverse-side view of a blade piece constituting the lower shear of the same shears.
Figure 3B:
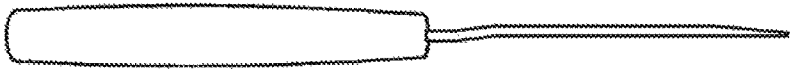
FIG. 3B is a plan view thereof.
Figure 3C:
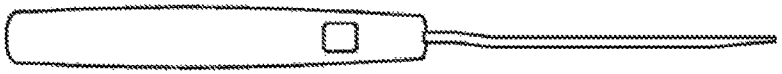
FIG. 3C is an underside view thereof.
Figure 3D:
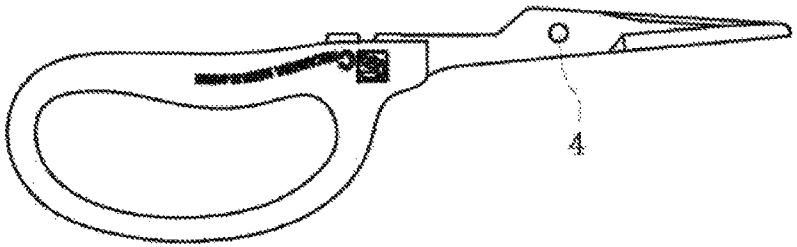
FIG. 3D is a reverse-side view thereof.
Figure 3E:
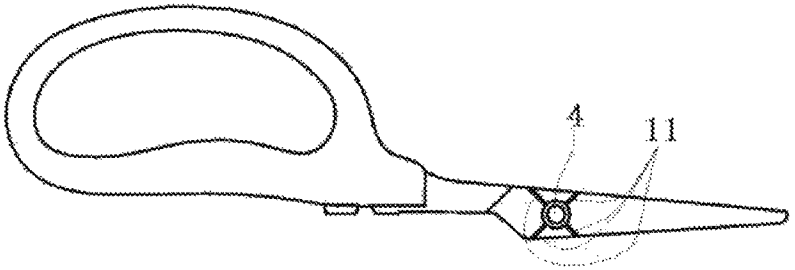
FIG. 3E is an obverse-side view of a modified example.

In the preferred embodiment example illustrated in the reverse-side view of FIG. 2D, the pin hole 8 has a square geometry. As indicated in FIGS. 2B and 2C, grooves 10 extending radially from the pin hole 8 are provided penetrating through to the edge of the cutting portion 7 of the blade piece 9.

FIG. 3 illustrates the configuration of the blade piece 5 constituting the lower shear. FIG. 3A presents an obverse-side view of the blade piece 5 shown in FIG. 1A, FIG. 3B a plan view, FIG. 3C an underside view, and FIG. 3D a reverse-side view. As is clear from FIGS. 3A and 3D, the hole 4 in the shears 1 is round, and along the inner-side face that opposes the blade piece 9 there are no grooves. As a modified example, as indicated in FIG. 3E, grooves 11 may be provided along the inner-side face that opposes the blade piece 9. Specifically, grooves encompassing the round pin hole 4, and grooves extending radially may be provided as the grooves 11.

Figure 1B:
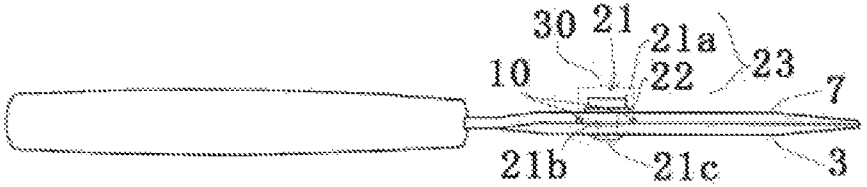
FIG. 1B is a plan view thereof.
Figure 4:
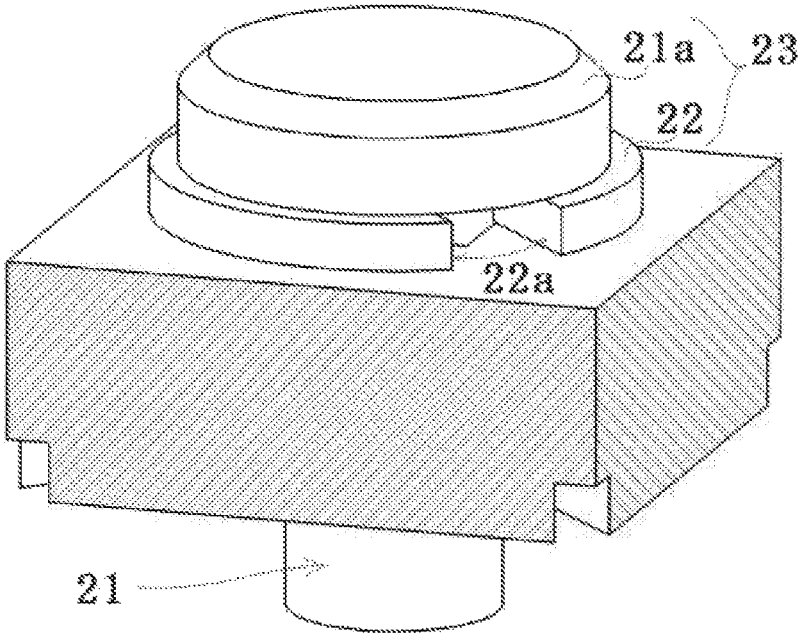
FIG. 4 is an isometric, enlarged view illustrating the pin and its environs.

FIG. 4 presents an isometric view of a section from a region 30, represented encompassed by the dotted lines in FIG. 1B, of the blade piece 9. Depiction of a section of the blade piece 5 is omitted. The cap portion 23 of the pin 20 is configured from two components as described above—namely, the rivet head (upper member) 21*a* and, provided between the rivet head 21*a* and the blade piece 9, the C-shaped washer 22 a section of whose arc is cut out (hereinafter, this cut-out section will be referred to as an opening 22*a*). Utilizing the washer 22 makes it possible to employ a general-purpose rivet having a columnar shaft. Specifically, with special processing on the rivet shank 21*b* being unnecessary, and with a punching process, for example, being sufficient to form the pin hole 8, the shears 1 may be manufactured exceedingly simply in a few operational steps, including preparation of the materials.

Further, as a modified example of the pin 20, instead of the rivet 21, a bolt and nut can be employed. In this case, the cap portion 23 is constituted by the bolt head or the nut, and the washer 22, and the cap portion 21*c* is constituted by the nut or the bolt head. And in this case, joining of the pin 20 into the blade piece 5 is carried out by cutting threads for the bolt into the pin hole 4 and screw-fastening it thereinto.

Figure 5:
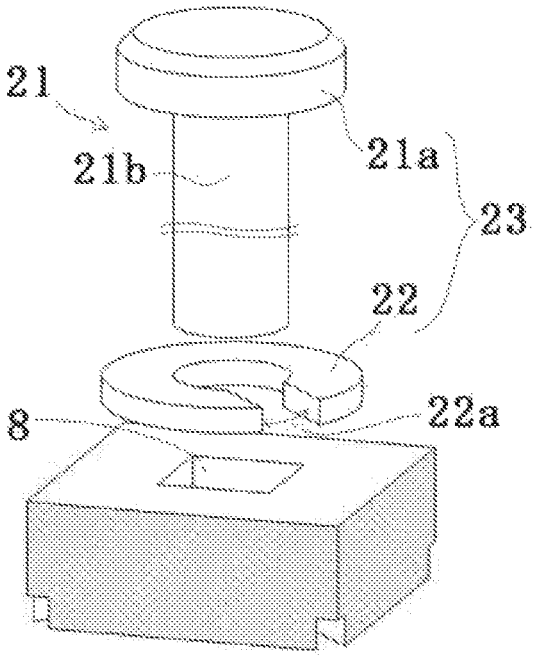
FIG. 5 is an isometric view illustrating a rivet that is inserted as a pin shank into the pin hole of, and a C-shaped washer for, the same shears.

FIG. 5 is an isometric view illustrating the rivet head 21*a* constituting the cap portion 23 of the shaft 20, the C-shaped washer 22, and the square pin hole 8. The shank 21*b* of the shaft 20 has a columnar form with a diameter whereby in a rotatable state the shank interiorly contacts the sides of the pin hole 8. Specifically, the diameter of the shank 21*b*, while being approximately the same as the length of one side of the square pin hole 8, is set to a slightly smaller value—for example, a value that is on the order of 1% to several % smaller than the length of one side of the pin hole 8—so that the pin 20 will be rotatable. The C-shaped washer 22 is made of stainless steel, and its inner diameter is established at a value whereby the washer fits snugly or fits slightly loosely onto the shank 21*b* of the rivet. While distance across the opening 22*a*—i.e., the length of the section indicated by the double arrow—facilitates cleaning the larger it is, it is established at a size whereby the washer 22 will not otherwise come off the shank 21*b*—for example, within a range of 1/15 to 1/3 of the outer peripheral length of the washer 22. In the shears 1, the distance across the opening 22*a* is given a size of about 1/13 of the outer peripheral length of the washer 22.

Figure 6:
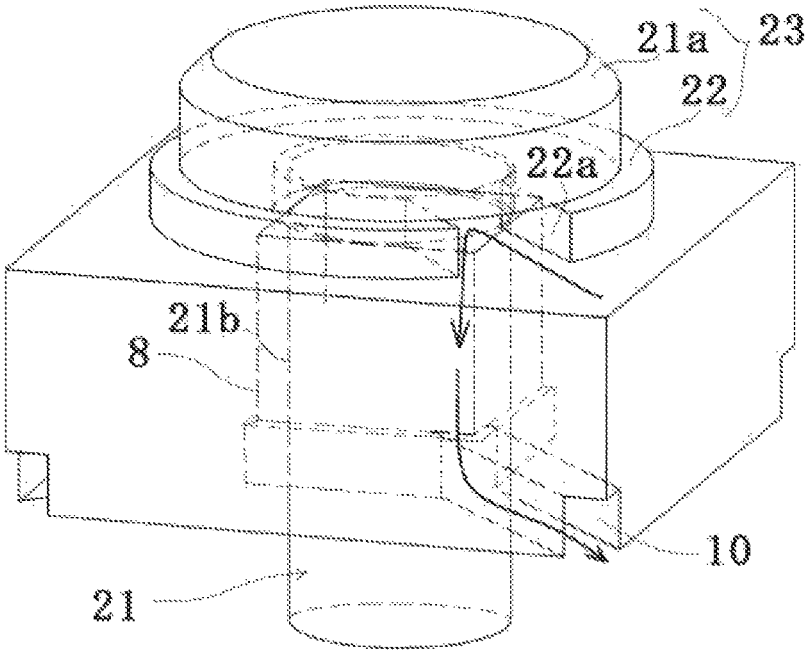
FIG. 6 is an isometric view indicating, with arrows, channels formed in the interior of the same shears, for cleaning-use washing fluid or air.

FIG. 6 visualizes and indicates with arrows a portion of channels formed in the pin hole 8 of the shears 1 for cleaning-use washing fluid or air. Only that portion of the grooves 10—which are provided radiating, for example, from the pin hole 8—used for explanation are drawn. The channels are constituted by the cut-out section (opening) 22*a* in the C-shaped washer 22, the space formed between the square pin hole 8 and the shank 21*b*, and the grooves 10 formed along the inner-face side of the blade piece 9. Setting up the channels makes it possible to clean out resinous gum, foreign matter, viscous grease, sticky substances, etc. built up in the pin hole 8 by passing cleaning-use washing fluid or air through the opening 22*a* in the C-shaped washer 22. Compared with situations where the pin hole 8, which has a bore form, is cleaned yet in which channels are not formed and a washer 22 that is, for example, C-shaped is not furnished, the hole can be cleaned out with exceeding effectiveness.

Figure 7A:
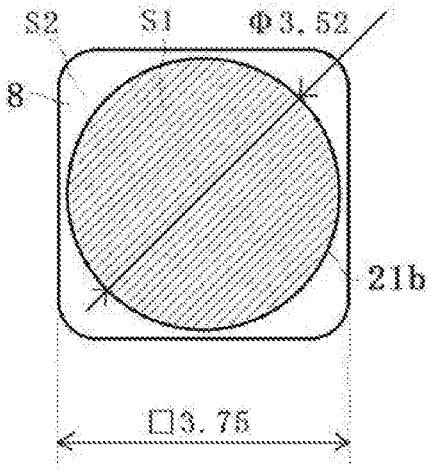
FIG. 7A indicates planar area existing between the pin hole and the pin shank of the same shears.

FIG. 7A is view where a state in which the shank 21*b* of the shaft 20 has been inserted into the square pin hole 8 is seen from above. For convenience of explanation, the cap portion 23 of the pin 20 is omitted. As an embodiment example, a case in which the diameter of the shank 21*b* is taken to be 3.52-mm gauge and the single-side length of the pin-hole 8 square is 3.75 mm will be considered. Given the problem of process precision of the punching die employed during manufacture, the four corners of the pin hole 8 assume a form in which they are round-chamfered by a radius of 0.5 mm. A smaller radius at which the corners are round-chamfering processed is preferable. In the illustrated state, the planar area S1 of the shank 21*b* was 9.7314 $mm^2$, and the planar area S2 of the gap between the pin hole 8 and the shank 21*b* was 4.1165 $mm^2$.

Figure 7B:
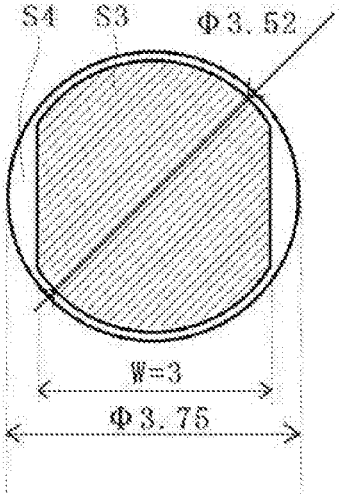
FIG. 7B is a diagram of a comparative example.

In cases where the pin hole 8 is made circular rather than polygonal, forming on the shank flat faces down the pin to secure channels for cleaning-use washing fluid or air is contemplated. For comparison's sake, as indicated in FIG. 7B, a case ("comparative example" hereinafter) was studied where instead of a square, a columnar pin hole with a 3.75-mm gauge diameter (the same measurement as the length of one side of the square pin hole 8) was used, and in order to provide the channels, either side of a shank with a 3.52-mm gauge diameter (the same measurement as the diameter of the shank 21*b*) were ground flat until having a width W=3 mm down the pin. In this case, the planar area S3 of the shank was 9.0830 $mm^2$, and the planar area S4 of the gap between the pin hole and the shank was 1.9617 $mm^2$, wherein it was found that with the present embodiment, an at least double the planar area for the channels can be broadly obtained. Furthermore, in the case of the embodiment example represented in FIG. 7A, adopting a configuration in which the columnar shank 21*b* is interiorly contacted rotatably against the sides of a square pin hole 8 allows the area where the pin hole and pin shank come into surface contact to be lessened compared with configurations in which the pin hole is rendered to have a columnar geometry, realizing a light operational feel as a result.

Figure 8A:
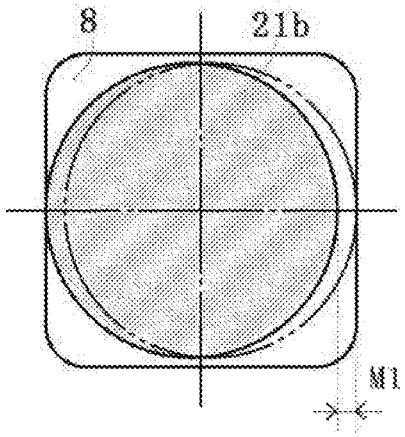
FIG. 8A indicates amount of pin-shank deflection that can arise within the pin hole of the same shears.
Figure 8B:
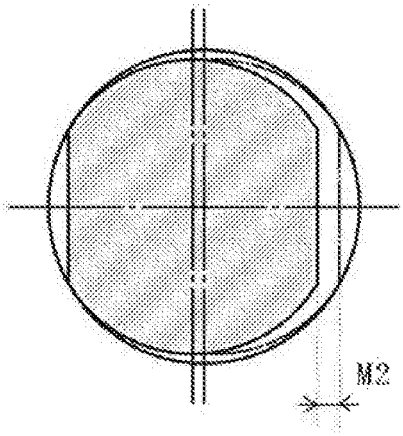
FIG. 8B is a diagram of a comparative example.

FIG. 8A indicates the maximum jiggle amount whereby the shank 21*b* can move within the pin hole 8 in the case of the embodiment example represented in FIG. 7A. A maximum jiggle amount of M1=0.23 mm was found for the case of the present embodiment example. FIG. 8B indicates the maximum jiggle amount whereby a pin shank can move within the pin hole in the case of the comparative example represented in FIG. 7B. A maximum jiggle amount of M2=0.267 mm was found for the case of the comparative example, from which it was understood that an exceedingly important effect for improvement in product quality could be obtained, in that the present embodiment example leads to a jiggle amount 14% less than that of the comparative example, facilitating aligning of the shear tips during manufacture.

Figure 9A:
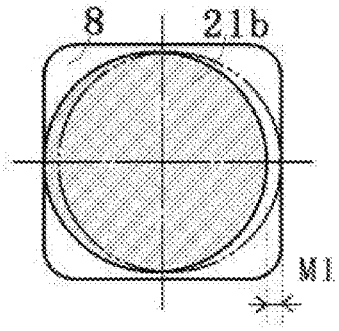
FIGS. 9A and 9B indicates amount of pin-shank jiggle that can arise within the pin hole of the same shears.
Figure 9B:
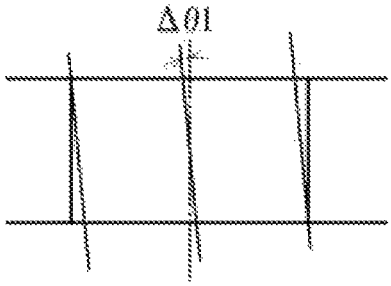
Figure 9C:
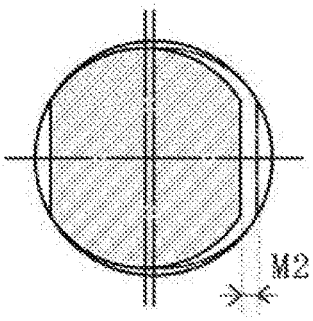
FIGS. 9C and 9D are diagrams of a comparative example.
Figure 9D:
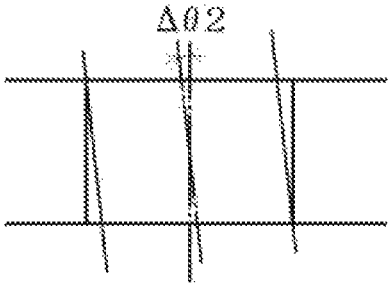

FIGS. 9A and 9B indicate the maximum degree to which the shank 21*b* can tilt in the pin hole 8 with thickness t of the blade pieces 5 and 9 being 2.3 mm. In the present-example instance, the pin tilts a maximum $\Delta\theta_1$=5.333 degrees, in which case a jiggling motion by M1=0.215 mm occurs. FIGS. 9C and D indicate the maximum degree to which a pin shank can tilt within the pin hole with the thickness t of the blade pieces 5 and 9 being 2.3 mm. In this comparative-example instance, it was found that the pin tilts $\Delta\theta_2$=6.185 degrees at maximum, in which case a jiggling motion by M2=0.249 mm occurs.

Jiggling of the shank 21*b* is amplified in the tip-end sections of the cutting portions 3 and 7 of the shears 1, hindering the operation of using the shears 1 what with the shear tips not mating. As will be understood from the comparisons in FIGS. 7 through 9, in the case of the present embodiment example, not only are channels secured, but jiggling can always be kept to a minimum irrespective of the orientation of the shank 21*b*.

Figure 10A:
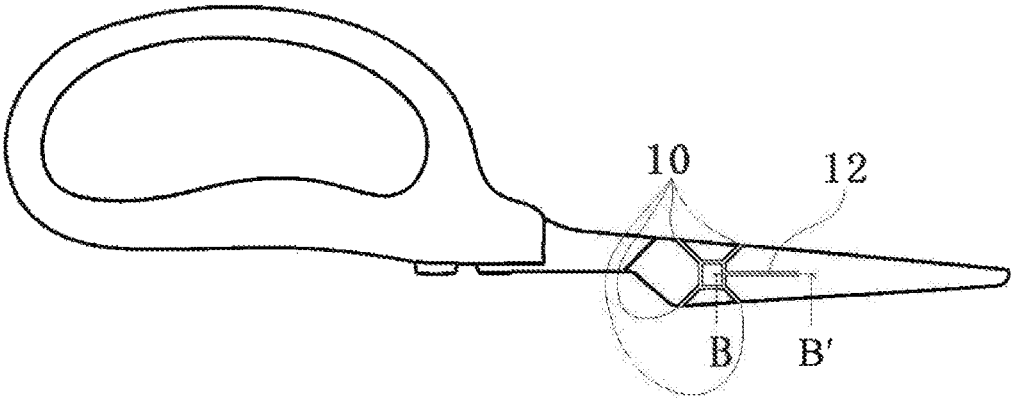
FIG. 10A illustrates a modified example of grooves provided in a blade piece for constituting shears.
Figure 10B:
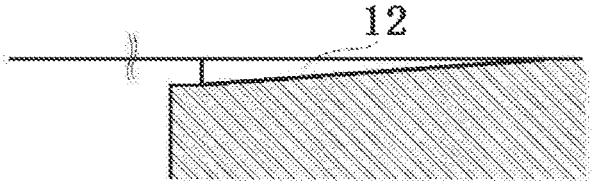
FIG. 10B is a sectional view along, seen in the direction of the arrows of, B-B' in FIG. 10A.
Figure 10C:
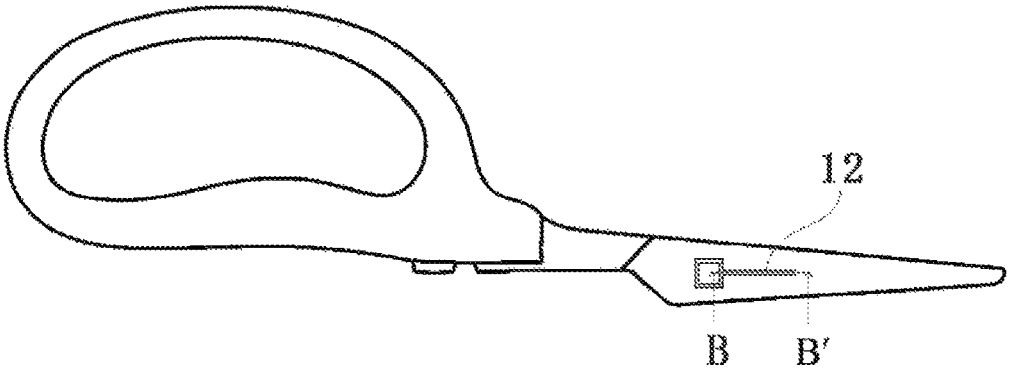
FIG. 10C illustrates a groove modification example in which a single furrow alone is provided in the blade piece.

FIG. 10 illustrate a modified example of the grooves 10 provided in the blade piece 9. FIG. 10A shows the inner-side face along which the grooves 10 provided in the blade piece 9 can be seen, and FIG. 10B presents, enlarged, a section taken along the line B-B' indicated in FIG. 10A. In this example, in addition to the grooves 10 illustrated in FIG. 2D, a furrow 12 is provided in the inner-side face so as to pass, when a part or the entirety of the cutting portion 7 is put into a predetermined state where it does not overlap, from the pin hole 8 to the area where the cutting portion does not overlap. "When a part or the entirety of the cutting portion 7 is put into a predetermined state where it does not overlap" means a state into which the shears 1 are prefixed—for example, an about half-opened state (a state in which a part of the cutting portion 7 does not overlap), or fully opened state (a state in which the cutting portion 7 completely does not overlap). It should be understood that both the grooves 10 and the furrow 12 may be provided (wherein reference is made to FIG. 10A), or only one of either may be provided, on the inner-side face of the blade piece 9 (wherein reference is made to FIG. 10C). Furthermore, the grooves 10 and the furrow 12 may be provided on the inner-side face of not only the blade piece 9, but the blade piece 5 as well.

As described in the foregoing, with the shears 1, the grooves 10 and the furrow 12, the gap made between the pin holes 4 and 8 and the shank 21*b*, and the cut-out section (opening) 22*a* in the C-shaped washer 22, not only allow washing-fluid or air channels for cleaning out the pin holes 4 and 8 to be secured, but also make it possible to do away with areas where the shank 21*b* comes into surface contact with the pin holes 4 and 8 and to substantially eliminate displacement of the shank, for a light, jiggle-free open/close operation.

It should be understood that the present invention is not limited to the above-described embodying modes and embodiment examples; various modified examples can be adopted as long as the actions and effects of the invention can be accomplished. For example, instead of the C-shaped washer 22, a rib washer provided with numerous grooves in a form radiating from the center area (the grooves being the opening) may be utilized, while alternatives to the washer 22 of stainless steel that may be employed include a copper or brass C-shaped (the break in the C form being the opening) oilless bush perforated with numerous small bores and put into an oil immersion.

Figure 11:
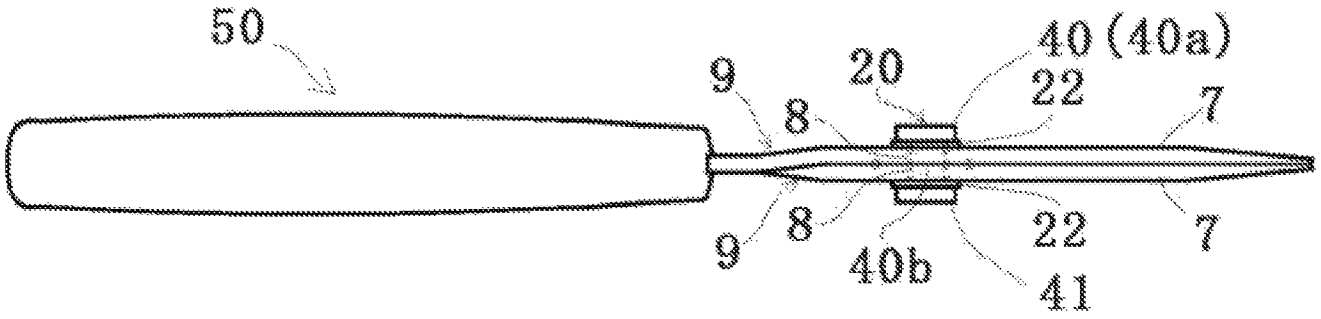
FIG. 11 is a lateral-side view of shears involving a modified example, in which the pin holes in the upper shear and the lower shear have a square geometry, and mouths are provided by C-shaped washers in either of the cap portions on the pin.

Also, in implementations where a bolt and a nut are utilized for the pin 20, as with the shears 50 illustrated in FIG. 11, instead of the blade piece 5, two blade pieces 9 may be employed and the pin holes in the upper shear and the lower shear may be made square. In this case, a bolt 40 and a nut 41 and two C-shaped washers 22 are employed as the pin 20. The head 40*a* of the bolt 40 and the washer 22 positioned above in the figure correspond to one cap portion; the threaded portion 40*b* of the bolt 40 corresponds to the shank; and the washer 22 positioned below in the figure and the nut 41 correspond to the other cap portion.

Adopting this configuration makes it possible to gain, without loosening of the bolt 40 and the nut 41, the satisfactoriness of operability and ease of cleaning that are above-described effects of the invention. In the scissors 50, having the blade piece constituting the upper shear and the blade piece constituting the lower shear be the same structure allows the number of parts to be halved, making it possible to improve volume productivity and to strategize cost reduction as a result.

Shears of the present invention include not only shears that are opened and closed manually, but also shears whose cutting portions are opened and closed by a motor or other automatic means. What is more, the present technology finds all-around applications in shears employed not only for gardening, but also for everyday household use, factory use, etc.—in environments where dirt, debris, and the like that are an interference with the opening and closing of the cutting portions can build up in the pin section.

LEGEND

1, 50: shears
2, 6: handles
3, 7: cutting portions
4, 8: pin holes
5, 9: blade pieces
10, 11: grooves
12: furrow
20: pin
21: rivet
21*a*: rivet head (upper member)
21*b*: shank
22: C-shaped washer
22*a*: cut-out section (opening) in C-shaped washer

What is claimed is:

1. Shears comprising:

two blade pieces, each having a cutting portion and a pin hole along a basal end of the cutting portion, in at least one of the two blade pieces the pin hole being a straight-sided polygonal bore; and a pin passing through the pin hole in each of the two blade pieces, the two blade pieces therein swiveling on the pin, the pin constituted by a columnar pin shank circular in cross-section and of diameter dimensioned relative to the polygonal bore so that swiveling the blade pieces on the pin causes the shank to graze against the interior sides of the polygonal-bore pin hole(s), and having on one of opposing ends of the pin shank an opening-constituting cap portion along the at least one blade piece with the polygonal-bore pin hole, and having on the other of the opposing ends of the pin shank an opposing-end cap portion, the opening-constituting cap portion having an opening interconnecting a gap, made between the polygonal-bore pin hole and the pin shank, with the opening-constituting cap portion's outer side; wherein at least one of the two blade pieces is provided with grooves on an inner-side face thereof opposing an inner-side face of the other of the blade pieces, the grooves being configured to form conduits leading from the pin hole in the at least one grooved blade piece exteriorly relative to where the at least one blade piece has the pin hole, either with the shears being in a blade-closed state in which the cutting portions are closed or with the shears being in a blade-partially-open state in which the cutting portions are open a predetermined amount, or both with the shears being in the blade-closed state and with the shears being in the blade-partially-open state.

2. The shears set forth in claim 1, wherein at least one of the two blade pieces is provided with a furrow disposed to pass from the pin hole to an area, existing in a state in which the two blade pieces are at least partially open, where a part or the entirety of the at least one blade piece's cutting portion does not overlap the other blade piece's cutting portion.

3. The shears set forth in claim 2, wherein the polygonal-bore pin hole has a square bore.

4. The shears set forth in claim 3, wherein the grooves extend radially from the pin hole.

5. The shears set forth in claim 2, wherein the grooves extend radially from the pin hole.

6. The shears set forth in claim 1, wherein the polygonal-bore pin hole has a square bore.

7. The shears set forth in claim 6, wherein the grooves extend radially from the pin hole.

8. The shears set forth in claim 1, wherein the grooves extend radially from the pin hole.

9. Shears comprising:

two blade pieces, each having a cutting portion and a pin hole along a basal end of the cutting portion, in one of the two blade pieces the pin hole being a straight-sided polygonal bore and in the other of the blade pieces the pin hole having a circular bore; and a rivet passing through the pin hole in each of the two blade pieces, the two blade pieces therein swiveling on the rivet, the rivet having a columnar pin shank circular in cross-section and of diameter dimensioned relative to the polygonal bore so that swiveling the blade pieces on the rivet causes the pin shank to graze against the interior sides of the polygonal-bore pin hole, and having on one of opposing ends of the pin shank an opening-constituting cap portion along the blade piece with the polygonal-bore pin hole, the opening-constituting cap portion being a rivet head and a C-shaped washer a section of whose arc is cut out, forming an opening interconnecting a gap, made between the polygonal-bore pin hole and the pin shank, with the opening-constituting cap portion's outer side, and the rivet having on the other of the opposing ends of the pin shank an opposing-end cap portion along the blade piece with the circular-bore pin hole, the opposing-end cap portion formed by the rivet's pin shank being crimped so that the two blade pieces are held pivotably in the pin hole; wherein at least one of the two blade pieces is provided with grooves on an inner-side face thereof opposing an inner-side face of the other of the blade pieces, the grooves being configured to form conduits leading from the pin hole in the at least one grooved blade piece exteriorly relative to where the at least one blade piece has the pin hole, either with the shears being in a blade-closed state in which the cutting portions are closed or with the shears being in a blade-partially-open state in which the cutting portions are open a predetermined amount, or both with the shears being in the blade-closed state and with the shears being in the blade-partially-open state.

10. The shears set forth in claim 9, wherein at least one of the two blade pieces is provided with a furrow disposed to pass from the pin hole to an area, existing in a state in which the two blade pieces are at least partially open, where a part or the entirety of the at least one blade piece's cutting portion does not overlap the other blade piece's cutting portion.

11. The shears set forth in claim 10, wherein the polygonal-bore pin hole has a square bore.

12. The shears set forth in claim 11, wherein the grooves extend radially from the pin hole.

13. The shears set forth in claim 10, wherein the grooves extend radially from the pin hole.

14. The shears set forth in claim 9, wherein the polygonal-bore pin hole has a square bore.

15. The shears set forth in claim 14, wherein the grooves extend radially from the pin hole.

16. The shears set forth in claim 9, wherein the grooves extend radially from the pin hole.

17. Shears comprising:

two blade pieces, each having a cutting portion and a pin hole along a basal end of the cutting portion, in at least one of the two blade pieces the pin hole being a straight-sided polygonal bore; and a pin passing through the pin hole in each of the two blade pieces, the two blade pieces therein swiveling on the pin, the pin constituted by a columnar pin shank circular in cross-section and of diameter dimensioned relative to the polygonal bore so that swiveling the blade pieces on the pin causes the shank to graze against the interior sides of the polygonal-bore pin hole(s), and having on one of opposing ends of the pin shank an opening-constituting cap portion along the at least one blade piece with the polygonal-bore pin hole, and having on the other of the opposing ends of the pin shank an opposing-end cap portion, the opening-constituting cap portion having an opening interconnecting a gap, made between the polygonal-bore pin hole and the pin shank, with the opening-constituting cap portion's outer side; wherein the at least one of the two blade pieces having the polygonal-bore pin hole is provided with a furrow disposed to pass from the pin hole to an area, existing in a state in which the two blade pieces are at least partially open, where a part or the entirety of the at least one blade piece's cutting portion does not overlap the other blade piece's cutting portion.

* * * * *